US007198539B2

(12) United States Patent
Lam et al.

(10) Patent No.: US 7,198,539 B2
(45) Date of Patent: Apr. 3, 2007

(54) ARTIFICIAL EYE FOR DOLL OR THE LIKE

(76) Inventors: Fredericka D. Lam, 36101 Bob Hope Dr., Rancho Mirage, CA (US) 92270; Michael R. Lam, 36101 Bob Hope Dr., Rancho Mirage, CA (US) 92270

( * ) Notice: Subject to any disclaimer, the term of this patent is extended or adjusted under 35 U.S.C. 154(b) by 581 days.

(21) Appl. No.: 10/678,231

(22) Filed: Oct. 6, 2003

(65) Prior Publication Data

US 2004/0077279 A1 Apr. 22, 2004

Related U.S. Application Data

(60) Provisional application No. 60/419,524, filed on Oct. 21, 2004.

(51) Int. Cl.
*A63H 3/38* (2006.01)
*A63H 3/40* (2006.01)
*A63H 3/44* (2006.01)

(52) U.S. Cl. ..... 446/392; 446/343; 446/389; 446/393

(58) Field of Classification Search ..... 446/392, 446/393, 389, 343
See application file for complete search history.

(56) References Cited

U.S. PATENT DOCUMENTS 1,763,312 A * 6/1930 Marcus ..... 446/389
3,480,971 A * 12/1969 Smith ..... 623/6.64
3,846,199 A * 11/1974 Cappelli ..... 156/61
4,014,049 A * 3/1977 Richards et al. ..... 623/6.51
4,079,470 A * 3/1978 Deeg et al. ..... 623/6.56
4,166,293 A * 9/1979 Anis ..... 623/6.51
4,324,066 A * 4/1982 Smith et al. ..... 446/219
4,477,931 A * 10/1984 Kelman ..... 623/6.45
4,601,673 A * 7/1986 Nasca ..... 446/389
5,004,443 A * 4/1991 Su ..... 446/392
5,108,427 A * 4/1992 Majercik et al. ..... 623/5.12
6,652,004 B1 * 11/2003 Lam ..... 283/74

OTHER PUBLICATIONS http://www.goantiques.com.*

* cited by examiner

*Primary Examiner*—Boyer D. Ashley
*Assistant Examiner*—Mark Henderson

(57) ABSTRACT

An improved artificial eye for use in dolls, stuffed animals, other toys, and the like, and for use as a prosthetic eye for human beings. The improved artificial eye consists of a sclera, a lens, and a lamina. The lens can be made of any of a variety of materials such as natural or synthetic gemstones or gemstone simulations. The lens can be used to magnify the iris and pupil images. The lamina provides images of the iris and pupil. The lamina can be a thin layer imprinted with the image of the iris and pupil and is attached to the lens such as by lamination or adhesive. Alternatively, the lamina can comprise colored glass or ceramic and is sintered onto the lens. In a second configuration, the eye additionally comprises an insert layer, which can be glass, between the lens and the lamina.

58 Claims, 4 Drawing Sheets

ARTIFICIAL EYE FOR DOLL OR THE LIKE

CROSS REFERENCE TO RELATED APPLICATION

This application claims priority to U.S. provisional application Ser. No. 60/419,524, filed Oct. 21, 2002, which is incorporated in its entirety herein by reference.

FIELD OF THE INVENTION

This invention relates to artificial eyes. More specifically, this invention relates to artificial eyes for dolls and other applications.

BACKGROUND OF THE INVENTION

Dolls have been enjoyed by children the world over ever since the dawn of civilization. The materials used for manufacturing eyes for dolls have covered a wide variety of materials. For realism, however, eyes formed from glass have traditionally been used.

Glass eyes, however, are dull compared to the sparkle of real eyes. Further, when dolls having glass eyes are handled roughly, the glass forming the eyes can be easily scratched or broken.

SUMMARY OF THE INVENTION

The present invention is concerned with artificial eyes for use in such things as dolls, stuffed animals, manikins, models, statues, and any other application in which a realistic or fanciful artificial eye is desired, including prosthetic eyes for human beings. The present invention departs from previous solutions by the incorporation of natural or synthetic gemstones or gemstone simulations. The inherent characteristics of these materials provide artificial eyes with characteristics desirable over traditional artificial eyes.

The preferred embodiment of the artificial eye of the present invention includes a sclera-like element, a transparent or translucent combination cornea-lens-like element attached to the sclera-like element, and a combination iris-pupil-like element interposed between the sclera-like and cornea-lens-like elements. The iris-pupil element is visible through and may be magnified by the cornea-lens element. While the elements of the present invention as described by these terms reasonably correspond to the parts of a human eye, there is not a precise one-to-one correspondence between such elements and parts. For ease of referral herein, the sclera-like element is referred to as the sclera or base, the combination cornea-lens-like element as the lens, and the combination iris-pupil-like element as the iris-pupil lamina.

The lens of the artificial eye of the present invention is made from a transparent or translucent material, either natural or synthetic, having a density and hardness greater than glass. One preferred material for the lens is cubic zirconium, which has a high refractive index, excellent clarity, high density, and good hardness. On the MOS hardness scale, glass has a hardness of about 6.0, cubic zirconium of about 8.0, and diamond of 10.0.

In the past, cubic zirconium has been relatively expensive to manufacture and rare in the natural state. More recently, however, cubic zirconium has become more economical to manufacture and therefore less costly to obtain.

Artificial eyes using lenses made from cubic zirconium have greater clarity and sparkle than those made from glass. Additionally, cubic zirconium lenses magnify the irises and pupils of artificial eyes, and are more durable and less susceptible to damage and breakage than glass lenses.

BRIEF DESCRIPTION OF THE DRAWINGS

In the drawings, identical reference numerals refer to identical elements.

DETAILED DESCRIPTION OF THE PREFERRED EMBODIMENTS

A strength of the present invention is the realism and accurate mimicry of human and animal eyes. However, while this detailed description references human and animal eyes, the present invention is also applicable to fanciful eyes which have no counterpart in nature. Furthermore, while this description uses the terms iris and pupil as components of artificial eyes produced according to the present invention, the present invention is not limited to eyes having both an iris and a pupil. For example, the present invention can be used to produce fanciful eyes having only an iris or only a pupil or neither, having instead some other image where the iris and pupil would normally be.

Artificial eyes of the present invention may be any reasonable size desired such as a fraction of life size through larger than life size. Unless otherwise noted, the proportions of the eye elements, such as the relative diameters of the iris and pupil and the radius of the sclera, are chosen to approximate as closely as possible the natural proportions of the eye being mimicked.

According to a current dictionary, the term "frit" is "1: the calcined or partly fused materials of which glass is made or 2: any of various chemically complex glasses used ground especially to introduce soluble or unstable ingredients into glazes or enamels." Merriam-Webster's Collegiate Dictionary (2002). As used herein, the term "frit" additionally includes one or more pieces of colored glass for use in the creation of a lamina depicting colored irises and pupils for artificial eyes.

Figure 1:
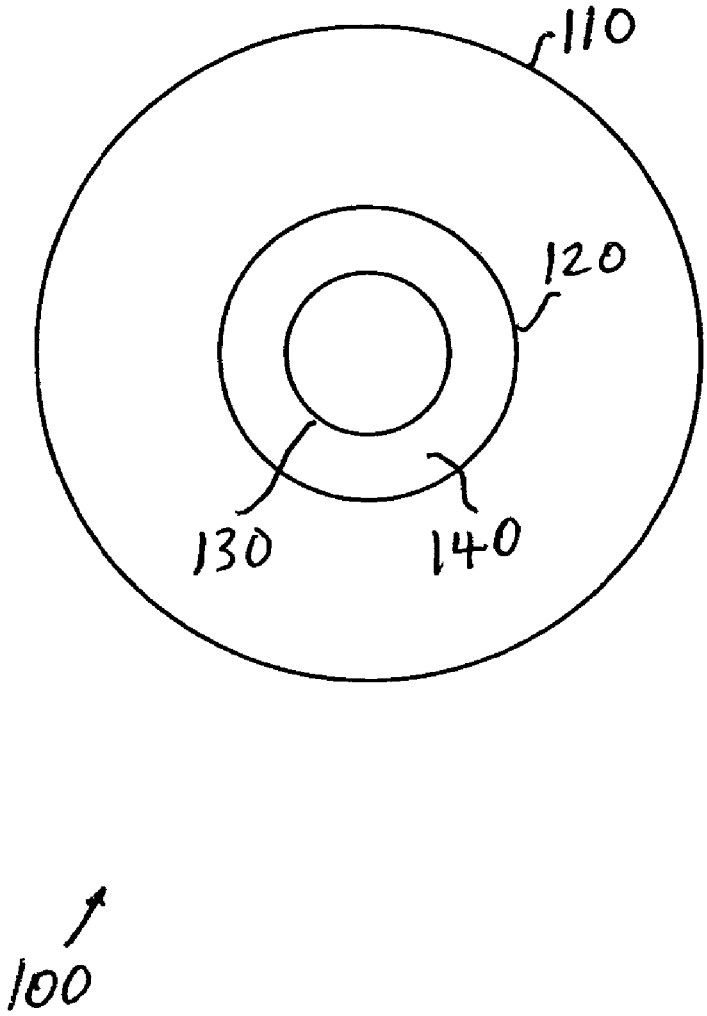
FIG. 1 shows a front view of an artificial eye constructed in accordance with the present invention.

FIG. 1 shows a front view of an artificial eye 100 according to an embodiment of the present invention. The artificial eye 100 includes a base 110 and a lens 120.

Base 110 is visually observable when implanted in a doll as the white of the eye, i.e., the sclera. Viewed from the front, as in FIG. 1, base 110 is generally convex in form to provide the realistic shape of an animal or human sclera. The back of base 110 can be any shape necessary or desired to aid in insertion or attachment to a doll. In one embodiment, base 110 is generally hemispherical in shape. In a second embodiment, it is generally spherical in shape. However, any variation between these shapes can be used. Base 110 can additionally be generally spherical in form having a stem extending in back for compatibility with the mounting of traditional doll eyes. In one embodiment, base 110 is injection-molded out of ABS plastic. However, other materials, including glass, glass-substitutes, and other plastics can be used for the base.

Lens 120 corresponds generally to the cornea and lens of a human eye and through which images of an iris 140 and a pupil 130 are visible. Lens 120 is generally partially hemispherical in form with a generally flat back. Generally, applied to the back of lens 120 are materials defining a lamina for depicting iris 140 and pupil 130, including suitable coloring. This can be achieved in a variety of ways, such as the methods discussed below in relation to FIGS. 2 and 3.

In the present invention, lens 120 can be manufactured from any synthetic or natural gemstone or gemstone simulation that transmits visible light. Suitable materials include, but are not limited to, natural materials such as diamond, sapphire, topaz, beryl, quartz, zircon, and ruby; synthetic natural materials such as synthetic rutile, synthetic sapphire, and synthetic spinel; and generally synthetic materials such as cubic zirconium, strontium titanate, yttrium aluminate, and gadolinium gallium garnet.

Use of materials such as aforementioned for lens 120 has various advantages not available with the use of traditional materials such as glass. By way of example, the use of cubic zirconium for the lens provides a multitude of benefits including (1) optical superiority as the clarity and refractive index of cubic zirconium exceed that of glass; (2) enhanced durability as the hardness of cubic zirconium results in the lens being more scratch and fracture resistant than a glass lens; (3) increased sparkle as cubic zirconium tends to reflect more light than glass making a cubic zirconium lens appear more like a human or animal eye than a glass eye; (4) greater perceived value as cubic zirconium, being widely used in jewelry, results in the lens having a higher perceived value and quality.

As a feature of its design, in use lens 120 serves to magnify the images of iris 140 and pupil 130. Additionally, the lens tends to distort the iris and pupil images when the lens is viewed from an off-axis angle (i.e., when not directly in front of the eye), which can impart a more lifelike and realistic appearance to the artificial eye.

Figure 2:
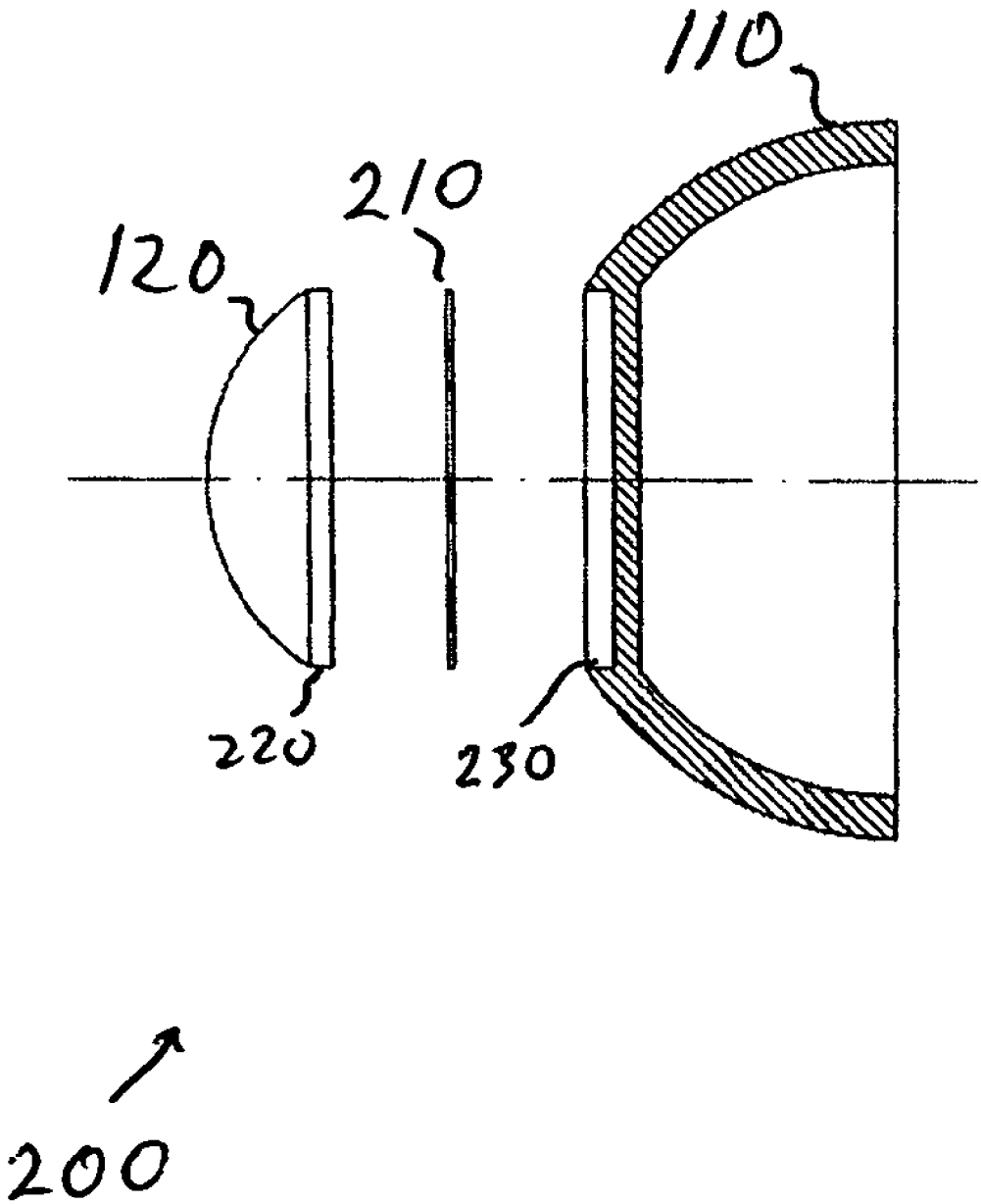
FIG. 2 shows an exploded cross-sectional view of an artificial eye constructed according to one embodiment of the present invention.

FIG. 2 shows an exploded cross-sectional view of an artificial eye 200 constructed according to one embodiment of the present invention. Shown is a lens 120, an iris-pupil lamina 210 depicting an iris 140 and a pupil 130, and a base 110. In this embodiment, lens 120 includes a cylindrical side wall 220. This allows the images of the iris and pupil to be physically further removed from the frontal surface of lens 120 creating an increased appearance of depth to the eye, which in some cases enhances the realistic appearance of the eye. Base 110 is shown having a depression 230. Lens 120 mates with and is attached into depression 230.

In the embodiment of FIG. 2, images of iris 140 and pupil 130 of lamina 210 are visible through lens 120. In one embodiment, lamina 210 comprises a thin ceramic disk which can be sintered onto the back of lens 120 by the application of elevated temperatures. In another embodiment, lamina 210 is formed from one or more suitably colored glass frits and then sintered directly onto the back of lens 120. In still another embodiment, lamina 210 comprises a photograph or drawing on paper or similar material depicting the desired iris and pupil images, such as printed images on paper, and is attached to the flat back of lens 120. Suitable materials for lamina 210 include any generally flat material capable of sustaining the desired images including, but not limited to, paper, plastic, cardboard, metal, and so forth. Further to this embodiment, lamina 210 providing the iris and pupil images can be laminated to lens 120 or attached by a suitable adhesive to the lens.

Once lens 120 and lamina 210 have been attached together, they can be mounted in base 110. In one embodiment, attachment of the lens 120-lamina 210 combination to base 110 is done by use of an adhesive. Generally, any adhesive that is strong, long-lasting and that does not cause discoloration of the iris and pupil images is suitable.

Figure 3:
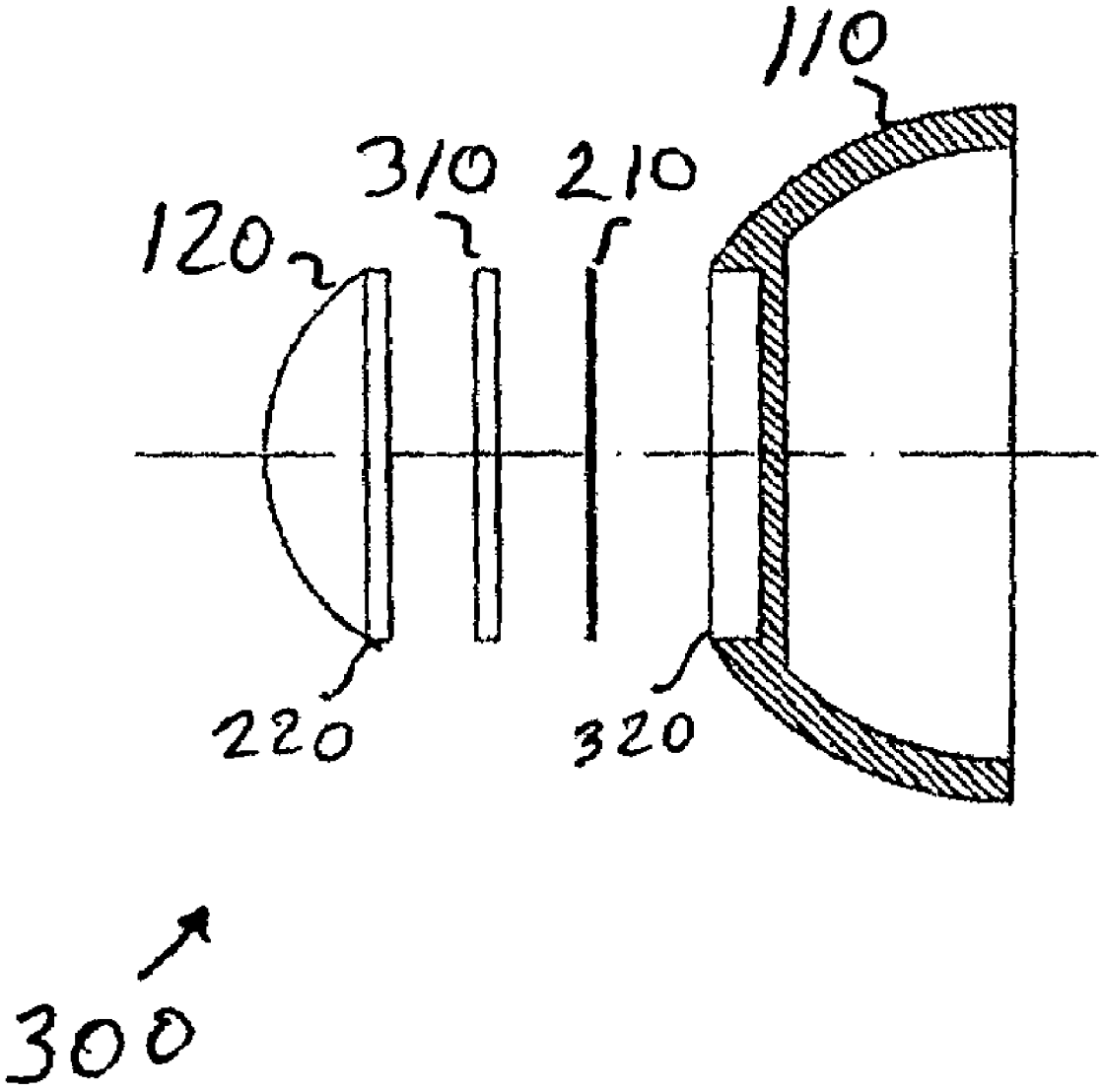
FIG. 3 shows an exploded cross-sectional view of an artificial eye constructed according to a second embodiment of the present invention.

FIG. 3 shows an exploded cross-sectional view of an artificial eye 300 constructed according to a second embodiment of the invention. Shown is a lens 120, an iris-pupil lamina 210, an insert 310, and a base 110. In this embodiment, lens 120 is again shown having a cylindrical side wall 220. In other embodiments, side wall 220 is not necessary. Insert 310 provides additional distance between the frontal surface of lens 120 and the plane of lamina 210, i.e., the plane of the iris and pupil images. As discussed previously in relation to FIG. 2, this increased distance can create an appearance of heightened depth to the eye (i.e., depth to the plane of the iris and pupil images) which in some cases enhances the realistic appearance of the eye. In one embodiment, insert 310 is formed from either optical or ordinary glass. Lamina 210 can be applied to insert 310 by any of the methods discussed in relation to FIG. 2 for attaching the lamina to lens 120. Once insert 310 and lamina 210 have been joined, insert 310 can be attached to lens 120 by adhesive. Generally, any adhesive that is strong, long-lasting, non-visible, and maintains non-visibility with aging is suitable.

Base 110 is shown with a depression 320 for receiving the lens 120-insert 310-lamina 210 combination. Depression 320 can be deeper than depression 230 of FIG. 2 to accommodate the additional thickness of insert 310. The lens 120-insert 310-lamina 210 combination can be attached to base 110 by application of adhesive into depression 320.

In alternate embodiments, the order of joining of lens 120, insert 310, lamina 210, and base 110 can be different. For example, lens 120 and insert 310 can be joined first, even by adhesive, and lamina 210 thereafter sintered onto insert 310, as discussed previously herein, provided the adhesive can withstand the sintering process.

Figure 4:
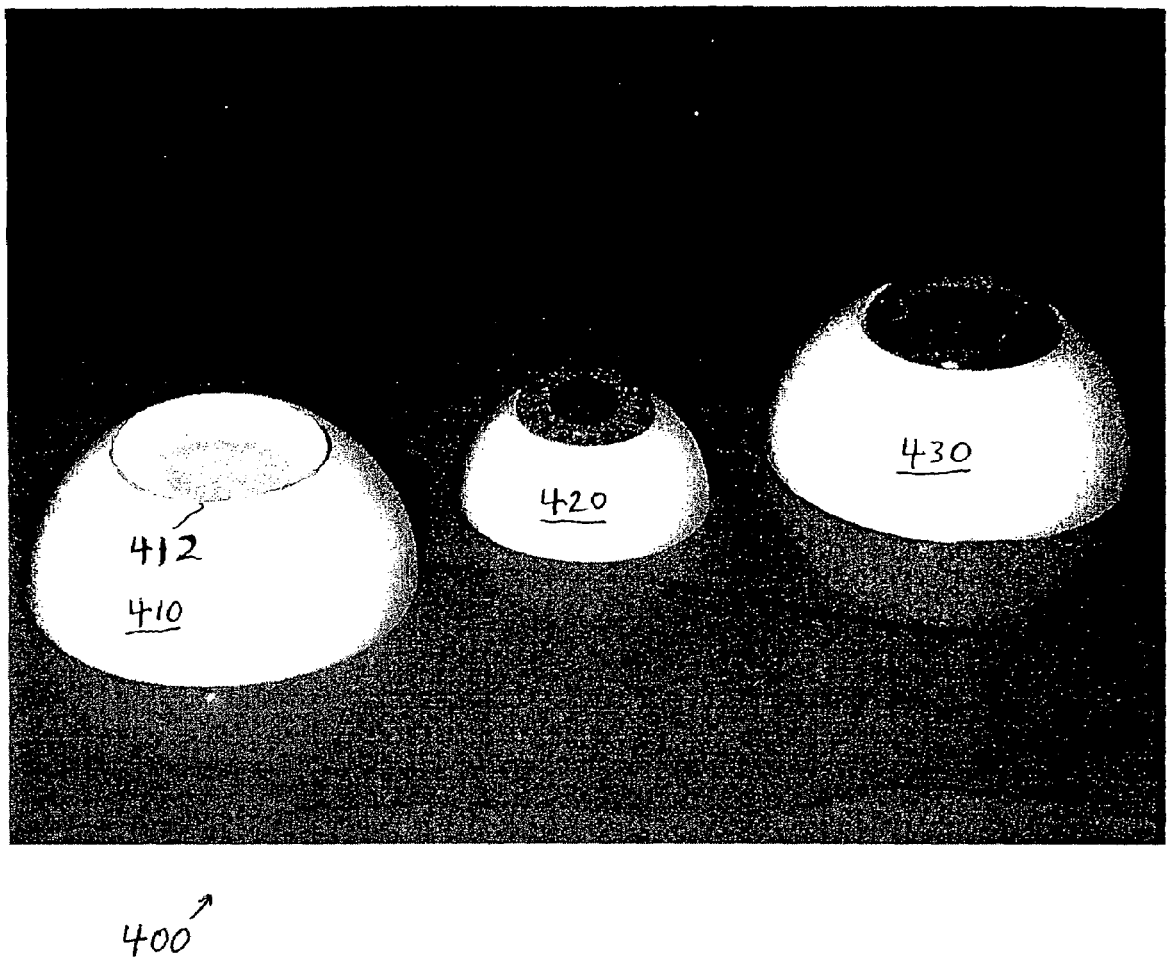
FIG. 4 shows a perspective view of one embodiment for one base and two artificial eyes in accordance with the present invention.

FIG. 4 shows a sclera or base 410 and two eyes 420 and 430 of the present invention. Base 410 is the leftmost of the three objects shown and is an example of a hemispherical base having an indentation 412 for receiving a lens. Eyes 420 and 430 are examples of artificial eyes produced from hemispherical bases and exhibit generally similar proportionality of component parts in two sizes. As an example of showing the alternate visual impact of varying component sizes relative to one another, the eye 430 has a larger pupil proportionally than the eye 420 has.

While the foregoing is a description of preferred embodiments of the artificial eye of the present invention, the invention is not limited to such embodiments but is defined by the scope of the following claims.

What is claimed is:

1. An artificial eye comprising:

a base formed from non-living material; and a lens-lamina structure, attached to said base, comprising:

a lens having a substantially flat backside, said lens comprising a natural material selected from the group consisting of diamond, sapphire, topaz, beryl, quartz, zircon, and ruby; and a lamina attached to said backside of said lens.

2. The artificial eye of claim 1 wherein said base is formed from a plastic.

3. The artificial eye of claim 1 further comprising:

an insert layer between said lens and said lamina.

4. The artificial eye of claim 2 wherein said base has a depression in its surface and said lens is receptively received in said depression.

5. The artificial eye of claim 4 wherein said lamina is formed from one selected from the group consisting of: colored ceramic material; one or more colored glass frits; a photographic image; and an image imprinted flat sheet.

6. The artificial eye of claim 3 wherein said base is formed from a plastic.

7. The artificial eye of claim 6 wherein said lamina is formed from one selected from the group consisting of: colored ceramic material; one or more colored glass fits; a photographic image; and an image imprinted flat sheet.

8. The artificial eye of claim 7 wherein said insert layer is made of glass.

9. An artificial eye comprising:

a base formed from non-living material; and a lens-lamina structure, attached to said base, comprising:

a lens having a substantially flat backside, said lens comprising a synthetic material selected from the group consisting of cubic zirconium, synthetic rutile, synthetic sapphire, synthetic spinel, strontium titanate, yttrium aluminate, and gadolinium gallium garnet; and a lamina attached to said backside of said lens.

10. The artificial eye of claim 9 wherein said base is formed from a plastic.

11. The artificial eye of claim 9 further comprising:

an insert layer between said lens and said lamina.

12. The artificial eye of claim 10 wherein said base has a depression in its surface and said lens is receptively received in said depression.

13. The artificial eye of claim 12 wherein said lamina is formed from one selected from the group consisting of: colored ceramic material; one or more colored glass fits; a photographic image; and an image imprinted flat sheet.

14. The artificial eye of claim 11 wherein said base is formed from a plastic.

15. The artificial eye of claim 14 wherein said lamina is formed from one selected from the group consisting of: colored ceramic material; one or more colored glass frits; a photograph; and an image imprinted flat sheet.

16. The artificial eye of claim 15 wherein said insert layer is made of glass.

17. A method of fabricating an artificial eye comprising:

attaching a lamina to a lens formed from a natural material selected from the group consisting of diamond, sapphire, topaz, beryl, quartz, zircon, and ruby to form a lens-lamina structure; and attaching said lens-lamina structure to a base formed from non-living material.

18. The method of claim 17 wherein the step of attaching a lamina to a lens comprises:

imprinting a Layer of material with an image of an iris and a pupil to form a lamina; and affixing, by means of an adhesive, said lamina to a lens.

19. The method of claim 17 wherein the step of attaching a lamina to a lens comprises:

suitably arranging one or more glass frits in relation to said lens; and sintering said one or more glass frits onto said lens to produce a lens-lamina structure.

20. A method of fabricating an artificial eye comprising:

attaching a lamina to an insert layer;

attaching said insert layer to a lens formed from a natural material selected from the group consisting of diamond, sapphire, topaz, beryl, quartz, zircon, and ruby; and attaching said lens to a base formed from non-living material.

21. The method of claim 20 wherein the step of attaching a lamina to an insert layer comprises:

imprinting a sheet of material with an image of an iris and a pupil to form a lamina, and attaching, by means of an adhesive, said lamina to an insert layer.

22. The method of claim 20 wherein the step of attaching a lamina to an insert layer comprises:

suitably arranging one or more glass fits in relation to said insert layer; and sintering said one or more glass frits onto said insert layer.

23. An artificial eye comprising:

base means for holding a lens means and for appearing white;

lens means coupled to said base means for visually transmitting visible light, said lens means comprising:

a natural material selected from the group consisting of diamond, sapphire, topaz, beryl, quartz, zircon, and ruby; and lamina means coupled between said lens means and said base means for creating a visual image of part of an eye.

24. The artificial eye of claim 23 wherein the lens means magnifies an image formed from visible light which is transmitted through said lens means.

25. The artificial eye of claim 24 wherein said part of an eye comprises an iris and a pupil or a fanciful image.

26. The artificial eye of claim 25 further comprising:

insert means coupled between said lens means and said lamina means for transmitting visual light and spacing the lamina means from the lens means.

27. A method of fabricating an artificial eye comprising:

attaching a lamina to a lens formed from a synthetic material selected from the group consisting of cubic zirconium, synthetic rutile, synthetic sapphire, synthetic spinel, strontium titanate, yttrium aluminate, and gadolinium gallium garnet to form a lens-lamina structure; and attaching said lens-lamina structure to a base formed from non-living material.

28. The method of claim 27 wherein the step of attaching a lamina to a lens comprises:

imprinting a layer of material with an image of an iris and a pupil to form a lamina; and affixing, by means of an adhesive, said lamina to a lens.

29. The method of claim 27 wherein the step of attaching a lamina to a lens comprises:

suitably arranging one or more glass frits in relation to said lens; and sintering said one or more glass frits onto said lens to produce a lens-lamina structure.

30. A method of fabricating an artificial eye comprising:

attaching a lamina to an insert layer;

attaching said insert layer to a lens formed from a synthetic material selected from the group consisting of cubic zirconium, synthetic rutile, synthetic sapphire, synthetic spinel, strontium titanate, yttrium aluminate, and gadolinium gallium garnet; and attaching said lens to a base formed from non-living material.

31. The method of claim 30 wherein the step of attaching a lamina to an insert layer comprises:

imprinting a sheet of material with an image of an iris and a pupil to form a lamina; and attaching, by means of an adhesive, said lamina to an insert layer.

32. The method of claim 30 wherein the step of attaching a lamina to an insert layer comprises:

suitably arranging one or more glass frits in relation to said insert layer; and sintering said one or more glass frits onto said insert layer.

33. An artificial eye comprising:

base means for holding a lens means and for appearing white;

lens means coupled to said base means for visually transmitting visible light, said lens means comprising:

a synthetic material selected from the group consisting of cubic zirconium, synthetic rutile, synthetic sapphire, synthetic spinel, strontium titanate, yttrium aluminate, and gadolinium gallium garnet; and lamina means coupled between said lens means and said base means for creating a visual image of part of an eye.

34. The artificial eye of claim 33 wherein the lens means magnifies an image formed from visible light which is transmitted through said lens means.

35. The artificial eye of claim 34 wherein said part of an eye comprises an iris and a pupil or a fanciful image.

36. The artificial eye of claim 35 further comprising:

insert means coupled between said lens means and said lamina means for transmitting visual light and spacing the lamina means from the lens means.

37. An improved doll having at least one eye comprising a lens coupled to a sclera formed from non-living material wherein the improvement comprises:

the lens comprising a synthetic material selected from the group consisting of cubic zirconium, synthetic rutile, synthetic sapphire, synthetic spinel, strontium titanate, yttrium aluminate, and gadolinium gallium garnet.

38. The improved doll of claim 37, said improvement further comprising:

a lamina attached to said lens, said lamina being characterized by one of the group consisting of colored ceramic material; one or more colored glass frits; a photographic image;

and an image imprinted flat sheet.

39. The improved doll of claim 37, said improvement further comprising:

an insert attached between said lens and said sclera.

40. An improved doll having at least one eye comprising a lens coupled to a sclera formed from non-living material wherein the improvement comprises:

the lens comprising a natural material selected from the group consisting of diamond, sapphire, topaz, beryl, quartz, zircon, and ruby.

41. The improved doll of claim 40, said improvement further comprising:

a lamina attached to said lens, said lamina being characterized by one of the g roup consisting of colored ceramic material; one or more colored glass frits; a photographic image;

and an image imprinted flat sheet.

42. The improved doll of claim 40, said improvement further comprising:

an insert attached between said lens and said sclera.

43. An artificial eye comprising:

a base formed from non-living material;

a lens formed from a natural material selected from the group consisting of diamond, sapphire, topaz, beryl, quartz, zircon, and ruby, said lens being attached to said base and having a backside oriented towards said base; and a lamina interposed between said base and said backside of said lens.

44. The artificial eye of claim 43 wherein said base is formed from a plastic.

45. The artificial eye of claim 43 further comprising:

an insert layer between said lens and said lamina.

46. The artificial eye of claim 44 wherein said base has a depression in its surface and said lens is receptively received in said depression.

47. The artificial eye of claim 46 wherein said lamina is formed from one selected from the group consisting of: colored ceramic material; one or more colored glass frits; a photographic image; and an image imprinted flat sheet.

48. The artificial eye of claim 45 wherein said base is formed from a plastic.

49. The artificial eye of claim 48 wherein said lamina is formed from one selected from the group consisting of: colored ceramic material; one or more colored glass fits; a photographic image; and an image imprinted flat sheet.

50. The artificial eye of claim 49 wherein said insert layer is made of glass.

51. An artificial eye comprising:

a base formed from non-living material;

a lens formed from a synthetic material selected from the group consisting of cubic zirconium, synthetic rutile, synthetic sapphire, synthetic spinel, strontium titanate, yttrium aluminate, and gadolinium gallium garnet, said lens being attached to said base and having a backside oriented towards said base; and a lamina interposed between said base and said backside of said lens.

52. The artificial eye of claim 51 wherein said base is formed from a plastic.

53. The artificial eye of claim 51 further comprising:

an insert layer between said lens and said lamina.

54. The artificial eye of claim 52 wherein said base has a depression in its surface and said lens is receptively received in said depression.

55. The artificial eye of claim 54 wherein said lamina is formed from one selected from the group consisting of: colored ceramic material; one or more colored glass fits; a photographic image; and an image imprinted flat sheet.

56. The artificial eye of claim 53 wherein said base is formed from a plastic.

57. The artificial eye of claim 56 wherein said lamina is formed from one selected from the group consisting of: colored ceramic material; one or more colored glass fits; a photograph; and an image imprinted flat sheet.

58. The artificial eye of claim 57 wherein said insert layer is made of glass.

* * * * *